US005218732A

United States Patent [19]

Pettigrew et al.

[11] Patent Number: 5,218,732

[45] Date of Patent: Jun. 15, 1993

[54] SURFACE TREATMENT APPARATUS

[76] Inventors: Rodney M. Pettigrew, 298 Savages Road, Brookfield, Queensland, 4069; John A. Xavier, 215 Pullenvale Road, Kenmore, Queensland, 4069, both of Australia

[21] Appl. No.: 838,803

[22] PCT Filed: Sep. 20, 1990

[86] PCT No.: PCT/AU90/00432

§ 371 Date: Mar. 16, 1992

§ 102(e) Date: Mar. 16, 1992

[87] PCT Pub. No.: WO91/03977

PCT Pub. Date: Apr. 4, 1991

[30] Foreign Application Priority Data

Sep. 20, 1989 [AU] Australia ..... PJ6459
Apr. 10, 1990 [AU] Australia ..... PJ9548

[51] Int. Cl.[5] ..... E01H 1/02

[52] U.S. Cl. ..... 15/4; 15/5; 15/79.2; 15/82; 15/179; 15/183

[58] Field of Search ..... 15/3-5, 15/79.1, 79.2, 82, 92, 179, 183, 366

[56] References Cited

U.S. PATENT DOCUMENTS

| | | | |
|---|---|---|---|
| 11,541 | 5/1896 | Dolph | 15/5 |
| 1,624,247 | 4/1927 | Hoover | 15/366 |
| 3,748,675 | 7/1973 | Schultz | 15/79.2 |
| 3,758,915 | 9/1973 | Zeski et al. | 15/5 |
| 4,156,298 | 5/1979 | Spence . | |
| 4,809,380 | 3/1989 | VanGinhoven et al. | 15/5 |

FOREIGN PATENT DOCUMENTS

| | | | |
|---|---|---|---|
| 124745 | 9/1944 | Australia . | |
| 157199 | 6/1954 | Australia . | |
| 274456 | 8/1965 | Australia . | |
| 270253 | 6/1966 | Australia . | |
| 405521 | 6/1968 | Australia . | |
| 2430317 | 1/1976 | Fed. Rep. of Germany . | |
| 2167915 | 8/1973 | France . | |
| 2229374 | 12/1974 | France . | |
| 7703285 | 9/1978 | Netherlands | 15/4 |
| 130647 | 12/1959 | U.S.S.R. | 15/366 |
| 248887 | 3/1926 | United Kingdom | 15/79.1 |

*Primary Examiner*—Edward L. Roberts
*Attorney, Agent, or Firm*—Larson and Taylor

[57] ABSTRACT

Apparatus reconditioning artificial turf surfaces by scarifying or brushing. Scarifying rods (13) and cleaning brushes (14) are mounted to a rotary work head (31) inside a wheeled housing which is pushed over the artificial turf surface as the work head rotates against the direction of movement to lift compacted blades above their sand bed and clean them of slime coatings.

9 Claims, 4 Drawing Sheets

SURFACE TREATMENT APPARATUS

BRIEF OUTLINE OF THE INVENTION

This Invention relates to apparatus for treatment of artificial turf surfaces such as tennis court surfaces, other sport surfaces and the like, and in particular to apparatus which is useful in breaking bonding between blades or fibres of such a surface.

BACKGROUND ART

It is known to provide surfaces for tennis courts, which surfaces comprise material which mimics grass. It is usual, on laying a mat of such material, to work in a layer of sand to bed the material, with grass like elements of the mat projected above the sand. In use, the individual elements projected above the sand bed may be flattened. The blades may become introverted and be embedded in the sand. When folded flat over each other, the blades may bond to a degree and remain flat, degrading the surface characteristics such that a simple brushing will not raise the blades to restore the artificial grass. Bacteria may breed in the material to create a slimy surface further degrading the usefulness of the surface.

A slimy surface may cause a player to lose footing and can become dangerous.

One proposal for overcoming the above problems involves a vacuum cleaner type mechanism by which the bedding sand is withdrawn from the surface to be cleaned when it is replaced. Such an apparatus goes to unnecessary complications in overcoming the problem.

OBJECT OF THE INVENTION

It is an object of the present invention to provide an apparatus for the treatment of tennis courts and the like, which apparatus comprises elements whereby the surface is improved without removing the bedding sand and whilst the playing surface remains in place.

FEATURES OF THE INVENTION

The invention achieves its object in provision of a surface treatment apparatus for reconditioning artificial turf type surfaces such as tennis courts comprising:

a first means which scarifies the surface;

a second means which brushes the surface;

the first and second means being mounted to a rotatable shaft;

motive means whereby the shaft is rotated and the first and second means are repeatedly passed over the surface and in contact therewith; and support means having the rotatable shaft mounted therein which support means may be moved over the surface.

In a different aspect the invention provides a method of surface treatment for reconditioning artificial turf type surfaces such as tennis courts wherein the surface is scarified and brushed by a work head which presents prongs and bristles to the surface.

In performance of the invention the surface is scarified to break bonds between flattened surface elements and to raise introverted turf elements. Further the surface is brushed to create a cleaning action on the turf elements. The means to achieve the above two actions are conveniently mounted to project radially off a powered rotary shaft in an apparatus which moves over the surface to be treated.

In the specification the following terms are used with the meanings hereinafter defined, inclusive of their normal dictionary meanings, unless the context at any point in the specification calls for something more narrow.

Scarifier, scarifying means or scarifier elements comprise a means whereby a scarifying action is produced at the surface being treated, the scarifying action being sufficient to raise embedded material, break up compacted material and generally restore the blades of an artificial turf to their original free standing dispositions. Scarifying is by relatively rigid prong-like elements which are caused to sweep or move over the surface to scarify disturb agitate, pull at, or otherwise act upon the blades of an artificial turf.

Brushes, brush means or brush elements comprise a means whereby a brushing action is produced at the surface being treated the brushing action being sufficient to clean the playing surface of a coating of slime and generally restore the surface to its original less slippery condition. Brushing is by relatively flexible bristle like elements which are caused to sweep or move over the surface to brush, scour, rub or otherwise act the surface of the artificial turf.

Motive means is a source of power and may be any of a petrol engine, electric motor etc.

Support means is any housing frame, chassis, or other mounting means whereby a work head may be mounted in suitable disposition relative to a surface to be treated and may comprise means such as wheels, rollers, castors, etc, whereby the support means may be moved, pushed, or powered over the surface to be treated. The support means may incorporate height adjusting mechanisms whereby the closeness of the work head to the surface being treated may be adjusted.

Rod-like elements, prong-like elements, rods, prongs, etc are relatively rigid elongate elements of any material suited to engage the playing surface with little give and which are mounted together at one end in an open array form to be moved together over a surface being treated. In practice the rod-like elements may be mounted to penetrate the upper surface of the sand bed of a playing surface.

Bristles are relatively flexible elongate elements of any material suited to forming a brush which are bundled together and bound at one end to establish, preferably, an elongate brush with bristle ends that may engage a surface to be reconditioned.

BRIEF OUTLINE OF THE DRAWINGS

The invention will now be described with reference to a preferred embodiment as shown in the accompanying drawings in which FIG. 1 is a sectional view through a rotative element which forms the basis of apparatus in accordance with the invention.

FIG. 2 is a sectional view of a second embodiment of the element as shown in FIG. 1.

FIGS. 3 and 4 schematically represent the component elements of a machine incorporating the rotative elements of either of FIGS. 1 or 2.

DETAILED DESCRIPTION

Figure 1:
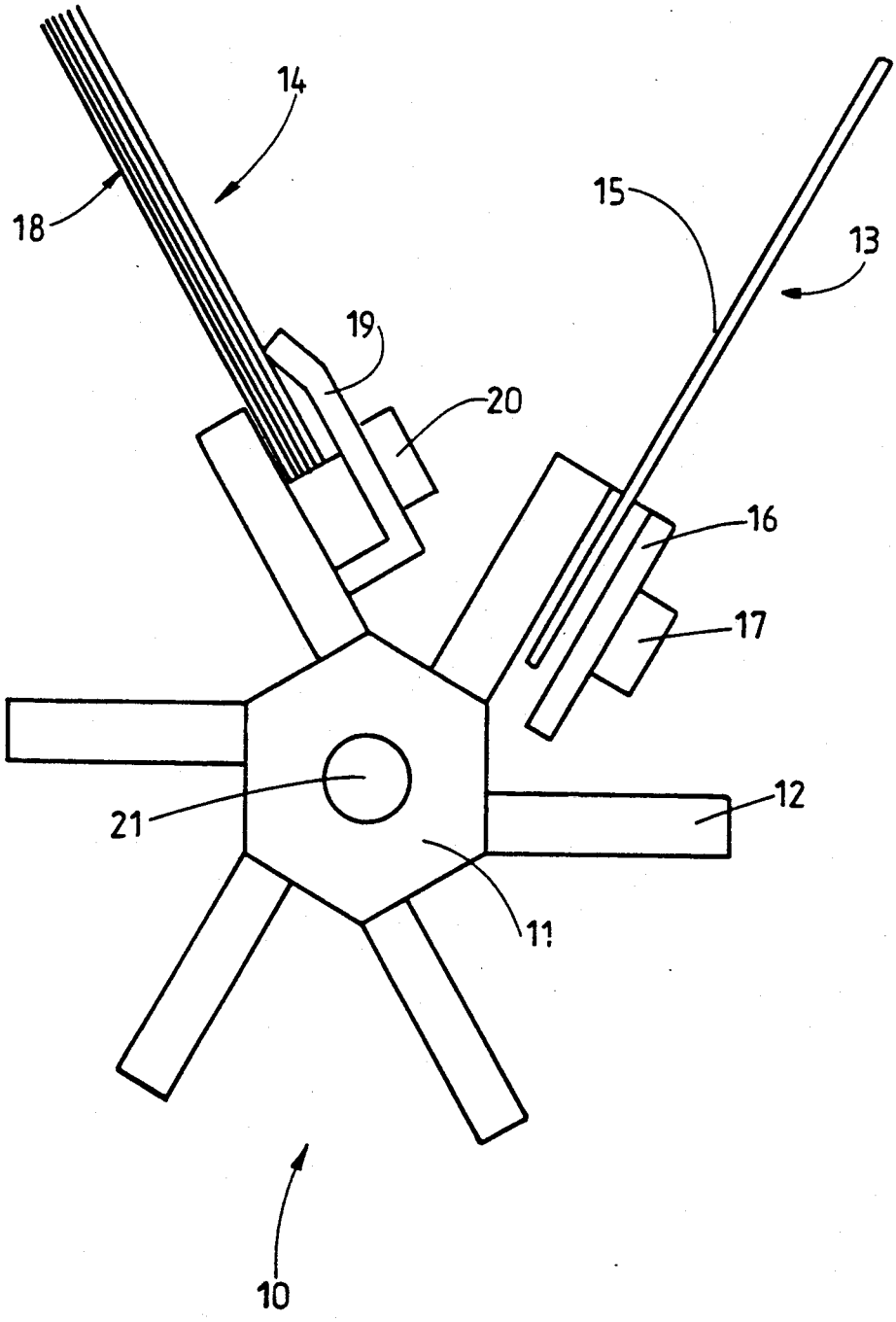

In FIG. 1 is seen a schematic representation of a sectional view of the active element or work head of an apparatus in accordance with the invention. What is illustrated is a transverse section through a rotatively mounted element (or work head) 10 which extends perpendicularly of the drawing. The element 10 comprises an elongate support body 11 having support plates 12 projected therefrom, being six in number in this embodiment. The support plates 12 mount an alternating angularly displaced series of scarifying elements or scarifying means 13 and brushing elements or brushing means 14. The scarifying elements may comprise a linear array of spaced parallel rod like elements or prongs 15 which might be disposed few centimetres apart along the full length of the rotative element. The rods or prongs 15 are held by suitable means such as a supporting plate 16 bolted to a support plate 12 by a bolt 17. The brushing elements may be a linear array of close packed brush bristles extended the full length of the rotative element to establish an elongate brush to about a centimetre thick. The brush bristles need to be sufficiently stiff so as to maintain an effective cleaning action when contacting the surface at their tips, and the bristles are not extended to the same height above the axis of rotation as the rods of the raking elements, being shorter by six to ten millimetres.

The above described rotative element or work head is mounted in use by a suitable support means parallel to the tennis court surface at a height which establishes contact with the surface of the successive scarifier and brush elements as the rotative element turns. The length of the element will be determined by the width of surface desired to be treated in one pass which in turn will be a result of convenience in use of the apparatus having in mind gates to be passed and the power output of standard motive means that can be conveniently applied to turning the rotative element. In use the rotative element is rotated to sweep forwardly in the direction of travel over the surface to be treated.

The elongate rotative element of FIG. 1 may be mounted in bearings at its ends on axle ends such as 21 depending on choice of bearings. One end of the elongate element might be provided with a gear or pulley by which to power the element. The rotative element bearings may be supported in bearing blocks on side plates of an enclosing housing or framework that may be provided with wheels and/or castors and/or rollers, etc by which the apparatus may be trailed over the tennis court. The enclosing housing and/or framework may support a suitable source of motive power such as an electric motor or a petrol engine that can be coupled to the rotative element by a chain or belt around pulleys or gears, or directly through meshed gears, with the drive chain being chosen to provide a suitable speed of rotation of the rotative element. It will be clear that any standard height adjustment mechanism might be incorporated into the housing to enable height setting of the rotative element either by height control of the housing and/or frame over its wheels and/or castors and/or rollers, or by adjustable mounting of the rotative element to the housing and/or frame.

Figure 2:
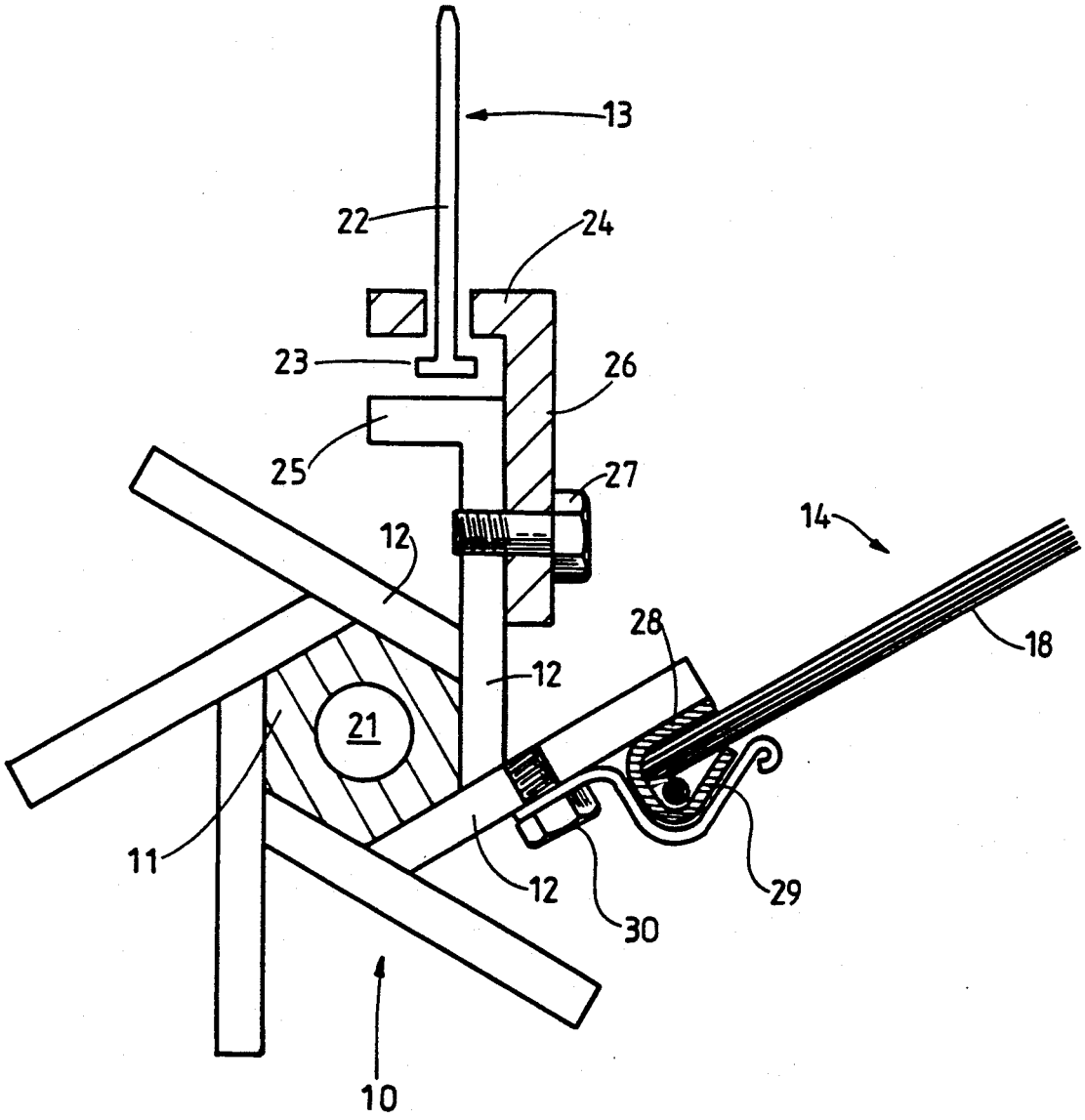

In FIG. 2, a rotatively mounted work head is shown in greater detail. The work head extends perpendicularly of the plane of the drawing with support plates 12 projected off shaft 11. The brush elements 14 may comprise bristles 18 clamped between the jaws of a crimped plate 28 which may be held to support plate 12 by a series of clamping elements 29 therealong. A bolt 30 may be used to capture crimped plate 28 and hold the brush 14 in place.

The scarifying element 13 is mounted with a degree of free play to its action in order to optimise performance. The scarifying element may comprise a rod 22 with a flat head 23 captured between plates 24 and 25 with rod 22 passed through a hole in plate 24. Plate 25 may be projected off support plate 12 and plate 24 may be fixed in place by a bolt 27 through plate 26 into support plate 12. By this means free play radially is enabled in the action of rod 22.

Figure 3:
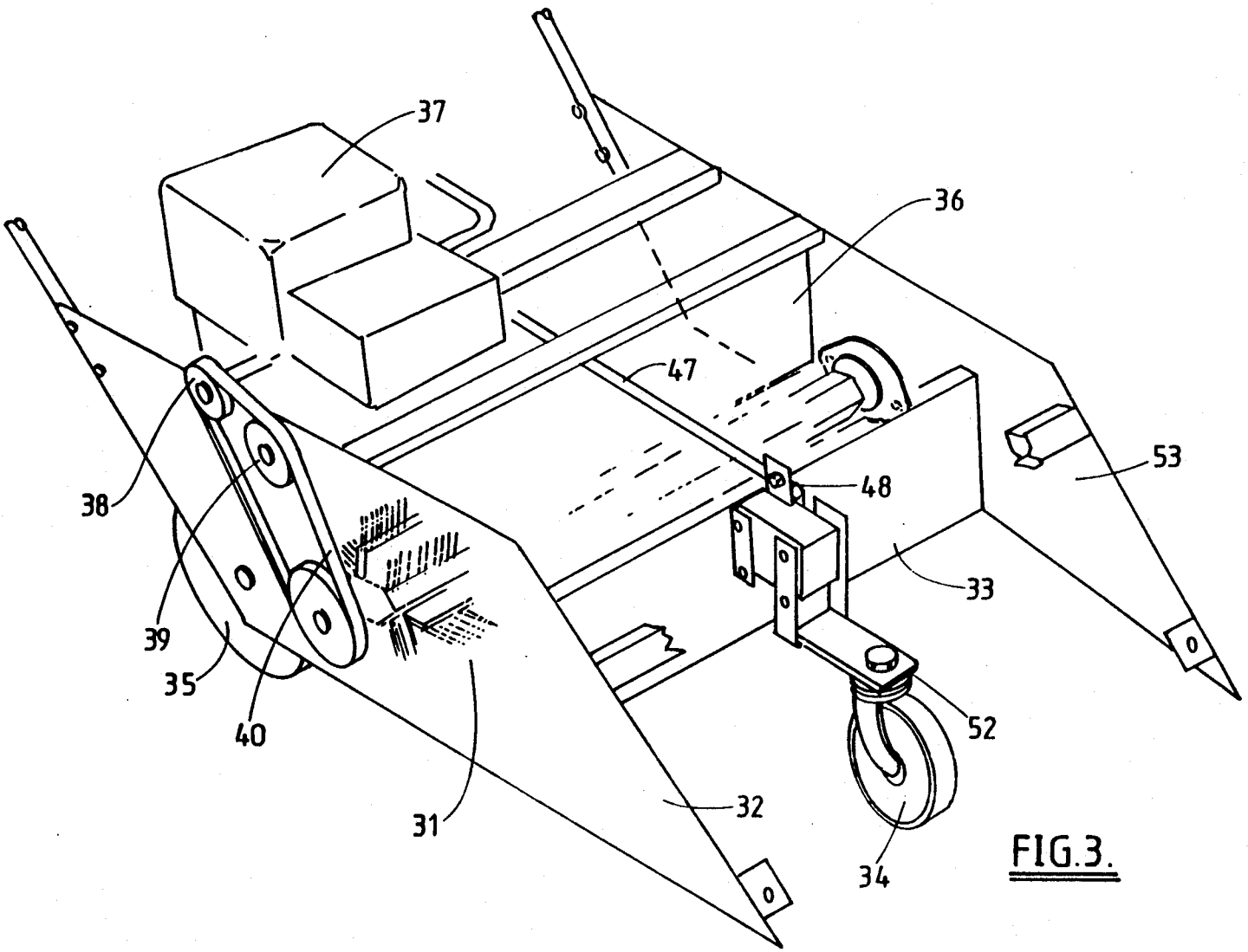
Figure 4:
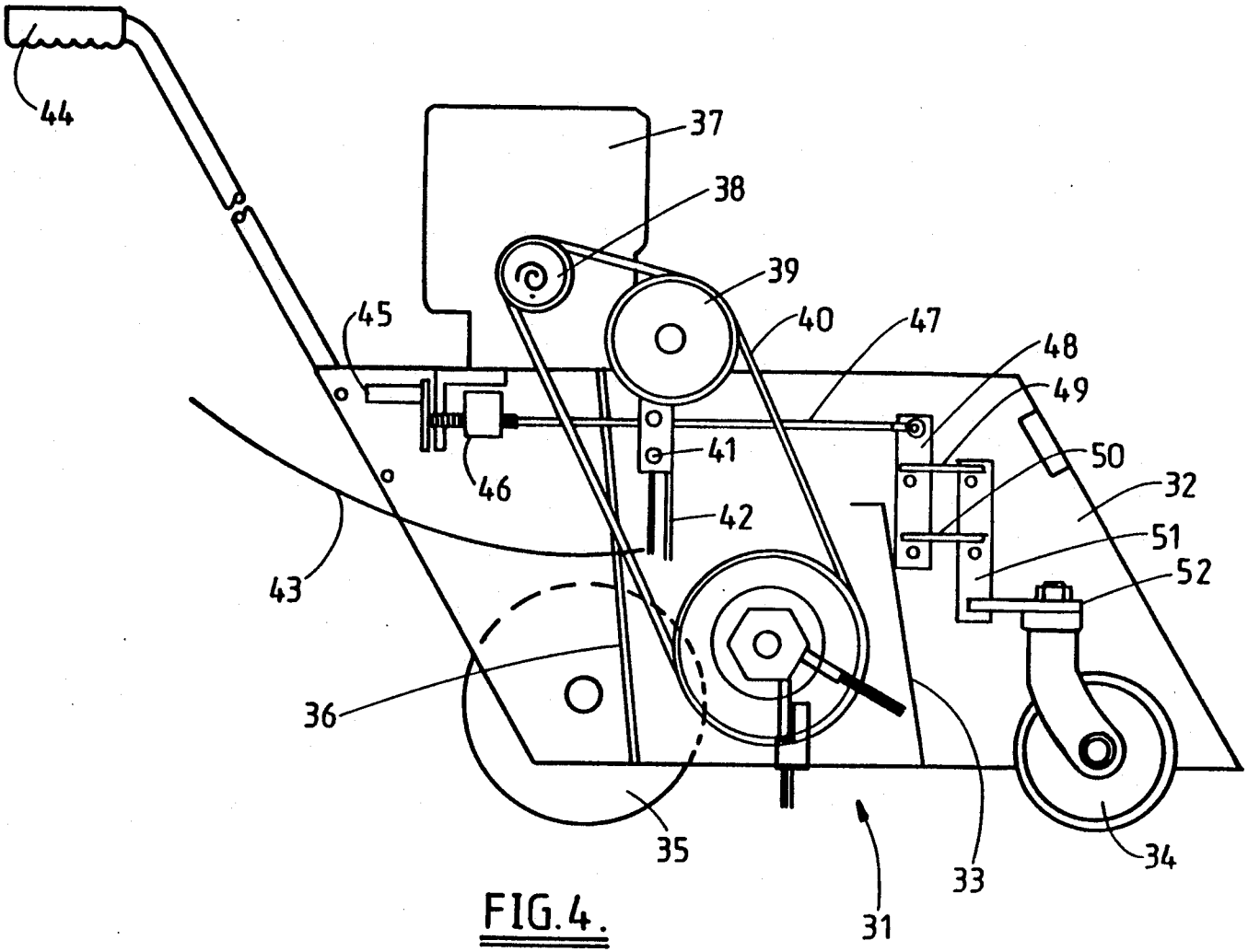

FIGS. 3 and 4 show schematically the relative dispositions of the elements of a machine which incorporates a work head 31 of the type described above.

The work head 31 is mounted in bearings supported at side walls 32 and 53 which may be spanned between the transverse walls 33 and 36 for and aft of work head 31. The machine may be supported at the front by a castor wheel 34 and at the rear by spaced apart solid rubber treaded wheels at each side of the machine (35 is in view). With a wheel format such as this, the machine is readily pushed in whatever direction the user wishes.

The work head 31 may be powered by interconnection with a suitable source of motive power and a petrol engine is indicated at 37 with an output pulley 38 around which a belt 40 is fitted. Belt 40 goes around a drive pulley on the axis of the work head and a jockey wheel 39 may be used to tension the drive belt 40 to engage the motor to the work head. The jockey wheel 39 may be mounted on a lever arm 42 pivoted at 41, the lever arm 42 being actioned by a clutch cable 43 which may be conveniently activated by a hand lever at machine handle 44.

It is possible to provide a height adjustment to the machine and a turning handle 45 might action a worm drive at 46 to draw a rod 47 which pulls a lever 48 to rotate a pivoted arm 49 of a pair of pivoted parallel links 49 and 50 whose movement controls the height of an arm 51 on which is a bracket 52 for mounting of castor wheel 34.

A machine of the above type is conveniently housed in a sheet metal box-like housing with provision to enclose the drive belt and castor wheel height adjusting mechanism and keep them free of interference. By using a hand operated clutch mechanism for engaging power to the work head, the machine is readily disengaged if the work head is detected to be working too deeply or jambs for any reason.

In use of the above apparatus, the action of the scarifying elements is such as to break bonds that might have formed between the blades of an artificial turf and to lift the blades, while the brush elements enable a cleaning action whereby bacterial slimes may be removed from the artificial turf.

It will be clear that the scale of the machine might be increased or decreased at will and in particular, the width of the machine is not critical to performance and is largely a matter of choice or simple preference. A hand pushed operation has proved satisfactory, the motor only being needed to power the work head.

It will be clear that the invention may be modified in it various details to produce a useful result and such modifications as may occur to a man skilled in the art are intended to be caught within the scope of the following claims.

We claim:

1. Surface treatment apparatus for reconditioning artificial turf type surfaces of the type such as a tennis court wherein blades of turf project from a sand base, said apparatus comprising:

first means for scarifying the surface by entering into the surface to provide subsurface treatment;

second means for brushing the surface, said second means comprising a radially extending brush:

a rotatable shaft on which the first and second means are mounted, said first and second means projecting radially outwardly from said rotatable shaft;

support means movable over the surface and having the rotatable shaft mounted therein; and motive means for powering the shaft so that said first and second means scarify and brush forwardly as the support means advances;

the second means comprising bristles extending axially along the shaft and extending radially outwardly from the shaft a distance which is shorter than the radial extension of the first means.

2. Surface treatment apparatus for reconditioning artificial turf type surfaces of the type where blades of turf project from a sand bed, said apparatus comprising:

first means for scarifying the surface;

second means for brushing the surface;

the first and second means being mounted on a powered shaft supported over the surface in a housing so that the first and second means may be advanced over the surface;

the first means comprising a linear array of spaced apart non-pivoting parallel rods, the array extending axially relative to the shaft and the rods projecting outwardly from the shaft;

the second means comprising an elongate brush extending axially along the shaft and including bristles projecting outwardly from the shaft; and the rods projecting a distance from the axis of the shaft greater than the distance that the bristles project therefrom.

3. Surface treatment apparatus for reconditioning artificial turf type surfaces of the type such as a tennis court wherein blades of turf project from a sand base, said apparatus comprising:

first means for scarifying the surface;

second means for brushing the surface;

the first and second means being mounted on and projecting radially from a rotatable shaft;

support means movable over the surface having the rotatable shaft mounted therein; and motive means for powering the shaft so that the first and second means scarify and brush forwardly as the support means advances;

the first means projecting radially from said shaft and the second means comprising bristles extending axially relative to the shaft and projecting radially outwardly from the shaft a distance which is shorter than the radial projection of the first means by 6 to 10 mm.

4. Surface treatment apparatus as claimed in claim 3 wherein:

the first means comprises at least one linear array of radially mounted spaced apart, mutually parallel rod-like elements, the linear array extending axially to the shaft.

5. Surface treatment apparatus as claimed in claim 4 wherein:

the rod-like elements are mounted with a limited degree of freedom radially relative to the shaft.

6. Surface treatment apparatus as claimed in claim 3 wherein:

the first and second means are arranged in an alternating sequence about the shaft, there being three of each of said first and second means.

7. Surface treatment apparatus as claimed in claim 3 wherein:

a plurality of the first and second means is provided in an alternating sequence about the shaft, the support means for the shaft comprising a housing for the first and second means, and said motive means comprising a drive belt engaging the shaft and connected to a source of motive power mounted on the housing.

8. Surface treatment apparatus as claimed in claim 7 wherein:

the belt is tensioned by a jockey wheel operated by a manual clutch cable.

9. Surface treatment apparatus as claimed in claim 7 wherein:

the housing is mounted at the rear on spaced apart free wheeling wheels and at the front on a castor wheel.

* * * * *